US010184732B2

(12) United States Patent
Ouradnik et al.

(10) Patent No.: US 10,184,732 B2
(45) Date of Patent: Jan. 22, 2019

(54) AIR TO AIR HEAT EXCHANGER

(71) Applicant: Modine Manufacturing Company, Racine, WI (US)

(72) Inventors: Zachary Ouradnik, Racine, WI (US); Keith Davis, Milwaukee, WI (US); Issac Dandan, Kenosha, WI (US); Kenneth Cornell, Waterford, WI (US); Benjamin Ranta, Kenosha, WI (US); Daniel Richards, Greendale, WI (US)

(73) Assignee: Modine Manufacturing Company, Racine, WI (US)

( * ) Notice: Subject to any disclaimer, the term of this patent is extended or adjusted under 35 U.S.C. 154(b) by 906 days.

(21) Appl. No.: 14/226,214

(22) Filed: Mar. 26, 2014

(65) Prior Publication Data

US 2014/0290920 A1 Oct. 2, 2014

Related U.S. Application Data

(60) Provisional application No. 61/805,712, filed on Mar. 27, 2013.

(51) Int. Cl.

| | |
|---|---|
| ***F28F 3/12*** | (2006.01) |
| ***F28F 3/00*** | (2006.01) |
| ***F28F 3/02*** | (2006.01) |
| ***F28D 1/03*** | (2006.01) |
| *F28D 21/00* | (2006.01) |

(52) U.S. Cl.

CPC ..... *F28F 3/025* (2013.01); *F28D 1/0366* (2013.01); *F28D 2021/0082* (2013.01);

(Continued)

(58) Field of Classification Search

CPC ..... F28F 3/00; F28F 3/02; F28F 3/08; F28F 3/12; F28F 9/001; F28F 9/005;

(Continued)

(56) References Cited

U.S. PATENT DOCUMENTS 3,542,124 A 11/1970 Manfredo et al.
4,434,845 A * 3/1984 Steeb ..... F28D 9/0062 165/153

(Continued)

FOREIGN PATENT DOCUMENTS

CN 1764816 4/2006
CN 101189417 5/2008

(Continued)

OTHER PUBLICATIONS

Chinese Patent Second Office Action for Application No. 201410114372.7 dated Sep. 25, 2017 (20 pages English Translation Included).

(Continued)

*Primary Examiner* — David Teitelbaum
*Assistant Examiner* — Harry Arant
(74) *Attorney, Agent, or Firm* — Michael Best & Friedrich LLP; Jeroen Valensa; Michael Bergnach

(57) ABSTRACT

An air to air heat exchanger includes a first and a second cooling air flow passage extending over a core depth of the heat exchanger. A heated air flow passage is arranged between the cooling air flow passages, and extends over a first percentage of the core depth. Thermally conductive separators are arranged between the heated air flow passage and each of the cooling air flow passages. A first structurally reinforced section is provided between the separators, and extends from a cooling air inlet face in the core depth direction over a second percentage of the core depth. A second structurally reinforced section is provided between the separators, and extends from a cooling air outlet face in the core depth direction over a third percentage of the core depth. The sum of the first, second, and third percentages is greater than 100 percent.

13 Claims, 3 Drawing Sheets

(52) U.S. Cl.
CPC ..... *F28F 2240/00* (2013.01); *F28F 2255/16* (2013.01); *F28F 2265/26* (2013.01)

(58) Field of Classification Search
CPC .. F28F 13/00; F28D 9/005; F28D 2021/0082; F28D 1/00366; F28D 9/0062; F28D 9/0087; F28D 1/0366; F28D 9/02; F28D 9/90075
See application file for complete search history.

(56) References Cited

U.S. PATENT DOCUMENTS 4,907,648 A * 3/1990 Emmerich ..... F28D 9/0062 165/165
6,019,169 A 2/2000 Ruppel et al.
7,628,199 B2 12/2009 Rothenhofer et al.

FOREIGN PATENT DOCUMENTS

CN 201382708 1/2010
CN 201835912 5/2011
DE 20208748 U1 10/2003

OTHER PUBLICATIONS

First Office Action from the State Intellectual Property Office of China for Application No. 201410114372.7 dated Dec. 20, 2016 (19 pages).

* cited by examiner

AIR TO AIR HEAT EXCHANGER

CROSS-REFERENCE TO RELATED APPLICATIONS

This application claims priority to U.S. Provisional Patent Application No. 61/805,712, filed Mar. 27, 2013, the entire contents of which are hereby incorporated by reference.

BACKGROUND

Air to air heat exchangers are commonly used to cool a heated stream of process air using ambient air. A particular example of such heat exchangers can be found in so-called charge air coolers for internal combustion engine systems. In such systems, the air being delivered to the combustion chambers is compressed using the otherwise wasted enthalpy remaining in the exhaust stream. The associated heating of the process air by this compression is undesirable, as it leads to increased emission levels of regulated pollutants, as well as a reduced engine thermal efficiency caused by the relatively low density of the heated air. It is therefore desirable for the compressed process air to be cooled prior to delivery of the air to the combustion chambers.

In some conventional constructions of air to air heat exchangers for charge air cooling, the heated air is cooled by a flow of ambient air that is directed in cross-flow orientation to the heated air. In one particular style of such a heat exchanger, commonly referred to as a bar-plate style, flat plates and bars are used to interleave alternating flow channels for the two fluids in order to transfer heat between them. Such heat exchangers are known to be susceptible to thermal fatigue, due to the stresses imparted on the heat exchanger by the high, fluctuating temperatures of the heated air.

SUMMARY

According to an embodiment of the invention, an air to air heat exchanger is provided and includes a first and a second cooling air flow passage extending from a cooling air inlet face to a cooling air outlet face. The distance between the cooling air inlet and outlet faces defines a core depth of the heat exchanger. A heated air flow passage is arranged between the cooling air flow passages, and extends over a first percentage of the core depth. Thermally conductive separators are arranged between the heated air flow passage and each of the cooling air flow passages. A first structurally reinforced section is provided between the separators, and extends from the cooling air inlet face in the core depth direction over a second percentage of the core depth. A second structurally reinforced section is provided between the separators, and extends from the cooling air outlet face in the core depth direction over a third percentage of the core depth. The sum of the first, second, and third percentages is greater than 100 percent.

In some embodiments, a portion of the core depth includes both part of the heated air flow passage and part of the first structurally reinforced section. In some embodiments, a portion of the core depth includes both part of the heated air flow passage and part of the second structurally reinforced section. In some embodiments a corrugated fin structure is provided between the separators in at least a portion of the heated air flow passage, and in some such embodiments the corrugated fin structure is located between the first and second structurally reinforced sections.

In some embodiments, the sum of the first, second, and third sections is at least 115%. In some such embodiments at least one of the second and third percentages is at least 12%.

According to some embodiments, at least one of the structurally reinforced sections includes a first, second, third, and fourth wall. The first wall extends from a heated air inlet face to a heated air outlet face, and from the first separator to the second separator. A face of the first wall is aligned with the cooling air inlet face or the cooling air outlet face. The second wall is spaced apart from the first wall and extends from the heated air inlet face to the heated air outlet face, and from the first separator to the second separator. The third and fourth walls join the first and the second walls, and each includes a face that is disposed against one of the separators. One or more flow channels for the heated air flow passage are arranged between the walls.

In some embodiments the one or more flow channels include a first and a second flow channel separated by a wall arranged between the first and second walls and extending between the third and fourth walls. In some embodiments the thickness of the first wall is substantially greater than the thickness of the second, third, and fourth walls.

DETAILED DESCRIPTION

Before any embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
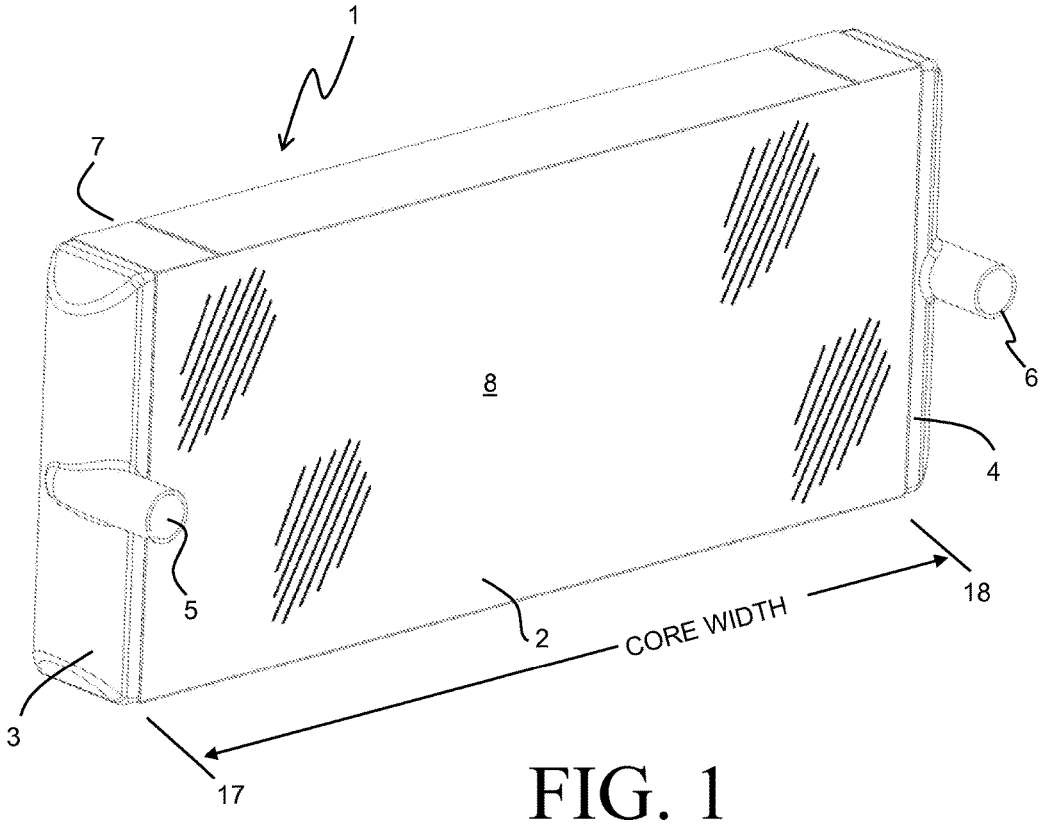
FIG. 1 is a perspective view of a heat exchanger according to an embodiment of the invention.
Figure 2:
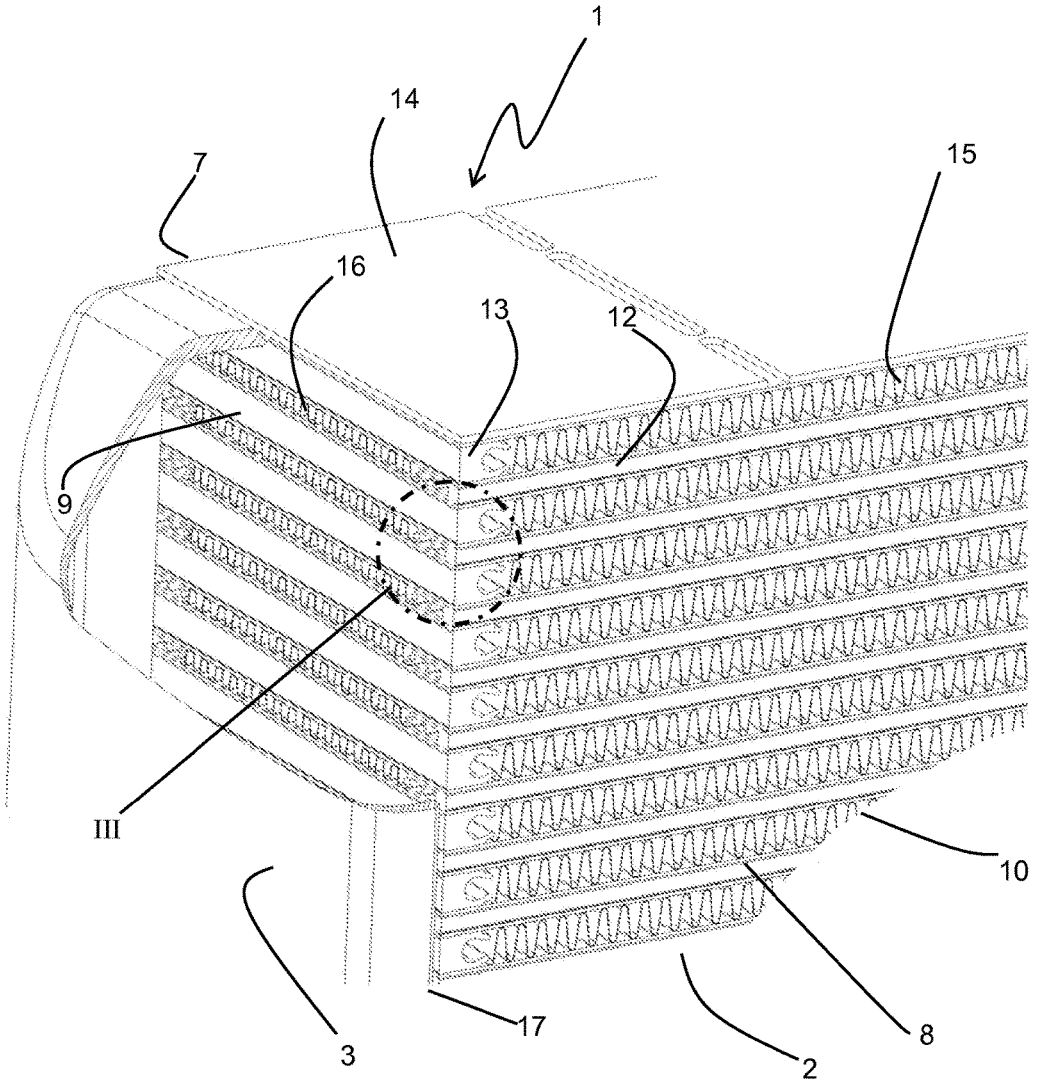
FIG. 2 is a partial perspective view showing selected portions of the heat exchanger of FIG. 1.
Figure 3:
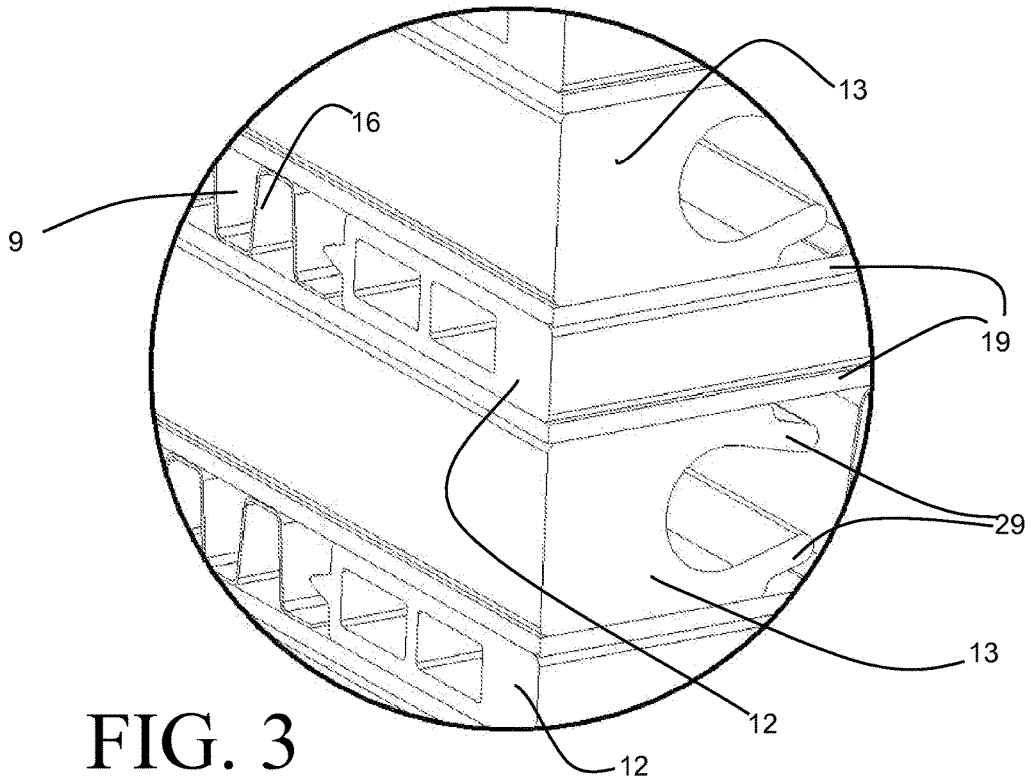
FIG. 3 is a detail view of the portion III of FIG. 2.

An air to air heat exchanger 1 according to an embodiment of the present invention is illustrated in FIGS. 1 and 2, and includes a heat exchange core 2 arranged between an inlet tank 3 and an outlet tank 4. The air to air heat exchanger 1 can be especially useful as a charge-air cooler, wherein a stream of compressed and heated air is cooled by another stream of cooler ambient air prior to being delivered to the intake of a combustion engine.

The exemplary heat exchanger 1 is of a bar-plate construction and includes a plurality of cooling air flow passages 10 interleaved with a plurality of heated air flow passages 9 between a pair of side plates 14 to define the core 2. The heated air flow passages 9 extend between a heated air inlet face 17 and a heated air outlet face 18. As best seen in FIG. 2, the heated air inlet face 17 is directly joined to an open end of the inlet tank 3, so that a flow of heated air can be received into the inlet tank 3 through an inlet port 5 provided therein, and can be directed through the heated air flow passages 9. In similar fashion, the heated air outlet face 18 is directly joined to an open end of the outlet tank 4 so that the heated air, having passed through the heated air flow passages 9, is received into the outlet tank 4, and is removed from the outlet tank 4 by way of an outlet port 6 provided therein. The spacing distance between the heated air inlet face 17 and the heated air outlet face 18 defines a core width of the core 2.

The cooling air flow passages 10 extend between a cooling air inlet face 7 and a cooling air outlet face 8. The cooling air outlet face 8 is shown in detail in FIG. 2, and it should be understood that the cooling air inlet face 7 is substantially similar to the cooling air outlet face 8. Cooling air can be directed through the cooling air flow channels 10 from the cooling air inlet face 7 to the cooling air outlet face 8 by way of a fan, blower, or other similar air mover (not shown). Alternatively, in some embodiments the heat exchanger 1 can be incorporated into a vehicle, and the motion of that vehicle causes the movement of cooling air through the cooling air flow channels 10. The spacing distance between the cooling air inlet face 7 and the cooling air outlet face 8 defines a core depth of the core 2. The core depth direction is perpendicular to the core width direction, so that the cooling air moving through the flow passages 10 is in a cross-flow orientation to the heated air moving through the flow passages 9.

Adjacent ones of the flow passages 9, 10 are separated from one another by relatively thin metallic separators 19. Additionally, the flow passages 9 are bounded by bars 12 extending in the core width direction between the heated air inlet face 17 and the heated air outlet face 18. Similarly, the flow channels 10 are bounded by bars 13 extending in the core depth direction between the cooling air inlet face 7 and the cooling air outlet face 8. The core width direction is typically substantially greater than the core depth direction, and as a result the bars 12 and 13 are commonly referred to as "long bars" and "short bars", respectively.

Thin metallic corrugated fin structures 15 can be provided within the cooling air flow passages 10 in order to provide additional structural support to the metallic separators 19, as well as to increase the rate of heat transfer between the heated air and the cooling air passing through the heat exchanger 1. Similarly, thin metallic corrugated fin structures 16 can be provided within the heated air flow passages 9 for the same purpose. In some especially preferable embodiments the separators 19, long bars 12, short bars 13, side plates 14, and fins 15, 16 are all constructed of aluminum alloy and are brazed together to define the heat exchanger core 2.

In the application of the air to air heat exchanger 1 as a charge-air cooler, the variations in flow of the heated air through the passages 9 result in thermal and/or pressure cycles that impart significant mechanical stresses on the heat exchanger 1. These stresses can have a deleterious effect on the ability of the heat exchanger 1 to provide a leak-free flow path for the heated air between the inlet port 5 and the outlet port 6. In order to improve the endurance of the heat exchanger 1 as it experiences such stresses, the short bars 13 are often constructed with elongated fingers 29 in order to provide some beneficial compliance as the heat exchanger 1 distorts due to the imparted stresses. In contradistinction, it has been found to be preferable to have the long bars 12 remaining rigid along the cooling air inlet face 7 and the cooling air outlet face 8.

The inventors have found that the ever-increasing demands being placed upon such charge-air heat exchangers require the distances over which the long bars 12 must provide rigid structural support to likewise increase. However, such an increase in the dimension of the long bars 12 in the core depth direction (i.e. from the faces 7, 8) is accompanied by an undesirable increase in the pressure drop incurred as the charge-air flows through the heated air flow passages 9. Such an increase in pressure drop is the direct result of the corresponding decrease in the flow area of the passages 9 as the overall core depth is held constant. While the core depth can be increased in order to accommodate the longer support region, such an increase in heat exchanger size is also undesirable.

In order to ameliorate the above described increase in pressure drop, the long bars 12 of the present invention include flow channels 24 extending through the long bars 12 between the heated air inlet face 17 and outlet face 18. The flow channels 24 allow for a portion of the core depth dimension to be used simultaneously as a portion of the heated air flow passage 9 and as structural support.

Figure 5:
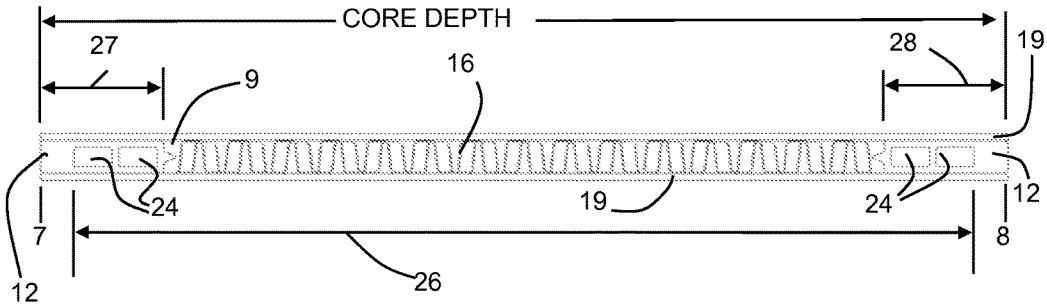
FIG. 5 is a side view of a single repeating section of the heat exchanger of FIG. 1.

As best seen in FIG. 5, a heated air flow passage 9, which includes the channels 24, extends over a section 26 of the heat exchanger core depth. The percentage of the core depth corresponding to the section 26 is preferably maximized in order to minimize the heated air pressure drop through the heat exchanger 1. A structurally reinforced section 27, provided by one of the long bars 12, extends into the core depth from the cooling air inlet face 7. Similarly, a structurally reinforced section 28, provided by another one of the long bars 12, extends into the core depth from the cooling air outlet face 8. The section 26 overlaps with the section 27 and the section 28, so that the sum of the percentages of the core depth corresponding to the sections 26, 27, and 28 exceeds 100%.

By way of example, in one particular embodiment of the invention the total core depth of the heat exchanger is 145 mm. Structurally reinforced sections, each extending a distance of 20 mm in the core depth direction, are provided at both the cooling air inlet face and the cooling air outlet face, so that each of the two structurally reinforced sections extend over approximately 14% of the core depth. The heated air flow passage extends over a width of 135 mm, or approximately 93% of the core depth. Consequently, the sum of the percentages of the core depth corresponding to the air flow passage and each of the two structurally reinforced sections is approximately 121%. In certain advantageous embodiments that total sum of the core depth percentages is at least 115%, and in some advantageous embodiments each of the structurally reinforced sections extend over at least 12% of the core depth.

While the heat exchanger 1 as shown in the accompanying figures shows identical long bars 12 at both the cooling air inlet face 7 and the cooling air outlet face 8, in other embodiments the long bars may differ in the percentage of the core depth over which they extend. Additionally, in some embodiments the section 26 overlaps with one, but not both, of the structurally reinforced sections 27, 28.

Figure 4:
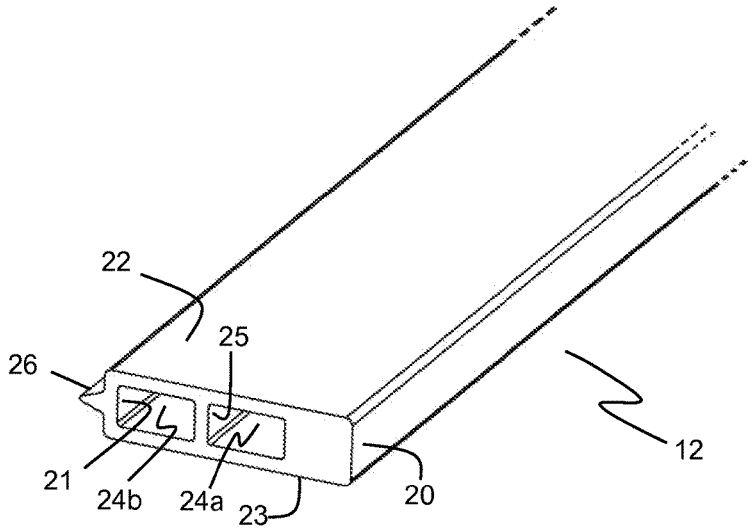
FIG. 4. is a partial perspective view of a long bar for use in the embodiment of FIG. 1.

The long bar 12 can be produced by extruding aluminum into the desired shape in lengths corresponding to the core width. In some highly preferable embodiments, the long bar 12 includes a wall 20 that has an outer face aligned with either the cooling air inlet face 7 or the cooling air outlet face 8. The wall 20 extends between the heated air inlet face 17 and the heated air outlet face 18, and spans the distance between the two separators 19 that bound the heated air flow passage 9. Another wall 21 of the long bar 12 is spaced inwardly in the core depth direction from the wall 22, and similarly extends between the heated air inlet face 17 and the heated air outlet face 18 and spans the distance between the two separators 19. The walls 21 and 20 are joined by walls 22 and 23. A face of the wall 22 is disposed against one of the separators 19, and a face of the wall 23 is disposed against the other one of the separators 19. One or more flow channels 24 are provided between the walls 20, 21, 22, 23. One or more walls 25 (one is shown) can be included in the long bar 12. The one or more walls 25 are located between the walls 20, 21 and extend between the walls 22, 23 to subdivide the space between the walls 20, 21, 22, 23 into multiple channels 24 (for example, the two channels 24*a* and 24*b* of FIG. 4). A relatively stiff structure can thereby be provided within the sections 27, 28 to structurally reinforce those sections, while still providing a portion of the flow passage 9 therein.

A protrusion 26 can optionally be provided on the inwardly-directed (i.e. facing away from the wall 20) face of the wall 21. The protrusion 26 can act to provide a suitable spacing between the long bar 12 and the convoluted fin structure 16 contained within the heated air flow passage 9 in order to ensure that heated air can flow between the wall 21 and the outermost convolution of the convoluted fin structure 16.

The thicknesses of the walls 20, 21, 22, 23, and the number and thickness of the walls 25, can be optimized to provide the requisite structural support while simultaneously maximizing the flow area of the channels 24. For example, the walls 20, 21, and 25 can be sized to prevent the undesirable buckling of the walls during thermal and/or pressure loads experienced by the heat exchanger 1 during operation. In some embodiments it may be especially advantageous for the outermost wall 20 to have a thickness that is substantially greater than that of one or more of the walls 21, 22, 23, 25, in order to provide greater reinforcement at the outermost faces of the heat exchanger 1. In one especially preferable embodiment the thickness of the wall 20 is five times the thickness of the other walls.

Various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention.

We claim:

1. An air to air heat exchanger comprising:

first and second parallel arranged, spaced apart cooling air flow passages extending from a cooling air inlet face to a cooling air outlet face, the distance between the cooling air inlet face and the cooling air outlet face defining a heat exchanger core depth;

a heated air flow passage arranged between the first and second cooling air flow passages and extending over a first percentage of the core depth, the heated air flow passage extending from a heated air inlet face to a heated air outlet face in a direction perpendicular to the core depth, the distance between the heated air inlet face and the heated air outlet face defining a heat exchanger core width;

a first thermally conductive separator between the first cooling air flow passage and the heated air flow passage;

a second thermally conductive separator between the second cooling air flow passage and the heated air flow passage;

a first structurally reinforced section arranged between the first and second separators, extending from the heated air inlet face to the heated air outlet face in the core width direction, and extending from the cooling air inlet face in the core depth direction over a second percentage of the core depth;

a second structurally reinforced section arranged between the first and second separators, extending from the heated air inlet face to the heated air outlet face in the core width direction, and extending from the cooling air outlet face over a third percentage of the core depth, wherein the sum of the first, second, and third percentages of the core depth is greater than 100 percent a corrugated fin structure arranged between the first and second thermally conductive separators in at least a portion of the heated air flow passage;

a first wall extending from the heated air inlet face to the heated air outlet face and extending from the first separator to the second separator, a face of the first wall being aligned with the cooling air inlet face;

a second wall extending from the heated air inlet face to the heated air outlet face and extending from the first separator to the second separator, the second wall being spaced away from the first wall;

a third wall extending from the heated air inlet face to the heated air outlet face and joining the first and second walls, a face of the third wall being disposed against the first separator;

a fourth wall extending from the heated air inlet face to the heated air outlet face and joining the first and second walls, a face of the fourth wall being disposed against the second separator; and one or more flow channels arranged between the first and second walls and between the third and fourth walls, the heated air flow passage comprising the one or more flow channels.

2. The air to air heat exchanger of claim 1, wherein the one or more flow channels includes a first and a second flow channel, the first structurally reinforced section further comprising a fifth wall extending from the heated air inlet face to the heated air outlet face and joining the third and fourth walls, the fifth wall being arranged between the first and the second wall to separate the first and second flow channels.

3. The air to air heat exchanger of claim 1, wherein the thickness of the first wall is substantially greater than the thickness of the second, third, and fourth walls.

4. The air to air heat exchanger of claim 1, wherein the first, second, third, and fourth walls are provided by an extruded bar extending over the core width.

5. An air to air heat exchanger comprising:

first and second parallel arranged, spaced apart cooling air flow passages extending from a cooling air inlet face to a cooling air outlet face, the distance between the cooling air inlet face and the cooling air outlet face defining a heat exchanger core depth;

a heated air flow passage arranged between the first and second cooling air flow passages and extending over a first percentage of the core depth, the heated air flow passage extending from a heated air inlet face to a heated air outlet face in a direction perpendicular to the core depth, the distance between the heated air inlet face and the heated air outlet face defining a heat exchanger core width;

a first thermally conductive separator between the first cooling air flow passage and the heated air flow passage;

a second thermally conductive separator between the second cooling air flow passage and the heated air flow passage;

a first structurally reinforced section arranged between the first and second separators, extending from the heated air inlet face to the heated air outlet face in the core width direction, and extending from the cooling air inlet face in the core depth direction over a second percentage of the core depth;

a second structurally reinforced section arranged between the first and second separators, extending from the heated air inlet face to the heated air outlet face in the core width direction, and extending from the cooling air outlet face over a third percentage of the core depth, wherein the sum of the first, second, and third percentages of the core depth is greater than 100 percent;

a corrugated fin structure arranged between the first and second thermally conductive separators in at least a portion of the heated air flow passage;

a first wall extending from the heated air inlet face to the heated air outlet face and extending from the first separator to the second separator, a face of the first wall being aligned with the cooling air outlet face;

a second wall extending from the heated air inlet face to the heated air outlet face and extending from the first separator to the second separator, the second wall being spaced away from the first wall;

a third wall extending from the heated air inlet face to the heated air outlet face and joining the first and second walls, a face of the third wall being disposed against the first separator;

a fourth wall extending from the heated air inlet face to the heated air outlet face and joining the first and second walls, a face of the fourth wall being disposed against the second separator; and one or more flow channels arranged between the first and second walls and between the third and fourth walls, the heated air flow passage comprising the one or more flow channels.

6. The air to air heat exchanger of claim 5, wherein the one or more flow channels includes a first and a second flow channel, the first structurally reinforced section further comprising a fifth wall extending from the heated air inlet face to the heated air outlet face and joining the third and fourth walls, the fifth wall being arranged between the first and the second walls to separate the first and second flow channels.

7. The air to air heat exchanger of claim 5, wherein the thickness of the first wall is substantially greater than the thickness of the second, third, and fourth walls.

8. The air to air heat exchanger of claim 5, wherein the first, second, third, and fourth walls are provided by an extruded bar extending over the core width.

9. An air to air heat exchanger comprising:

first and second parallel arranged, spaced apart cooling air flow passages extending from a cooling air inlet face to a cooling air outlet face, the distance between the cooling air inlet face and the cooling air outlet face defining a heat exchanger core depth;

a heated air flow passage arranged between the first and second cooling air flow passages and extending over a first percentage of the core depth, the heated air flow passage extending from a heated air inlet face to a heated air outlet face in a direction perpendicular to the core depth, the distance between the heated air inlet face and the heated air outlet face defining a heat exchanger core width;

a first thermally conductive separator between the first cooling air flow passage and the heated air flow passage;

a second thermally conductive separator between the second cooling air flow passage and the heated air flow passage;

a first wall extending from the heated air inlet face to the heated air outlet face and extending from the first separator to the second separator, a face of the first wall being aligned with one of the cooling air inlet face and the cooling air outlet face;

a second wall extending from the heated air inlet face to the heated air outlet face and extending from the first separator to the second separator, the second wall being spaced away from the first wall;

a third wall extending from the heated air inlet face to the heated air outlet face and joining the first and second walls, a face of the third wall being disposed against the first separator; and a fourth wall extending from the heated air inlet face to the heated air outlet face and joining the first and second walls, a face of the fourth wall being disposed against the second separator, wherein at least a portion of the heated air flow passage is located between the first and second walls and between the third and fourth walls.

10. The air to air heat exchanger of claim 9, wherein the first, second, third, and fourth walls are provided by an extruded bar extending over the core width.

11. The air to air heat exchanger of claim 9, wherein said portion of the heated air flow passage comprises a first flow channel and a second flow channel, the first and second flow channels being separated from each other by a fifth wall extending from the heated air inlet face to the heated air outlet face and joining the third and fourth walls, the fifth wall being arranged between the first and the second walls.

12. The air to air heat exchanger of claim 9 wherein the portion of the heated air flow passage is a first portion, further comprising corrugated fin structures extending between the first and the second separators to define a plurality of flow channels between the heat air inlet face and the heated air outlet face, the plurality of flow channels comprising a second portion of the heated air flow passage.

13. The air to air heat exchanger of claim 9, wherein the thickness of the first wall is substantially greater than the thickness of the second, third, and fourth walls.

* * * * *